US007160395B2

(12) United States Patent
Amos

(10) Patent No.: US 7,160,395 B2
(45) Date of Patent: Jan. 9, 2007

(54) METHOD AND APPARATUS FOR UNCLOGGING FLOW SYSTEMS

(76) Inventor: Stuart R. Amos, 1506 Phoenix Rd., Phoenix, MD (US) 21131

( * ) Notice: Subject to any disclaimer, the term of this patent is extended or adjusted under 35 U.S.C. 154(b) by 20 days.

(21) Appl. No.: 10/991,688

(22) Filed: Nov. 18, 2004

(65) Prior Publication Data

US 2005/0166946 A1 Aug. 4, 2005

Related U.S. Application Data

(60) Provisional application No. 60/520,662, filed on Nov. 18, 2003.

(51) Int. Cl.
*B08B 5/00* (2006.01)
*A47L 5/14* (2006.01)

(52) U.S. Cl. ..... 134/21; 134/22.11; 134/22.12; 15/330

(58) Field of Classification Search ..... 134/21, 134/22.1, 22.11, 22.12, 22.18; 15/301, 304, 15/345, 346, 353, 406, 330
See application file for complete search history.

(56) References Cited

U.S. PATENT DOCUMENTS

| | | | | |
|---|---|---|---|---|
| 2,129,415 | A | | 9/1938 | Fontenot |
| 2,267,064 | A | | 12/1941 | Wikelund |
| 2,673,986 | A | | 4/1954 | Schaefer |
| 2,714,898 | A | | 8/1955 | Reese |
| 3,189,934 | A | | 6/1965 | Steinwedel |
| 3,238,556 | A | | 3/1966 | Martin |
| 3,975,669 | A | | 8/1976 | Tyler |
| 4,055,405 | A | | 10/1977 | Thun-Hohenstein |
| 4,059,858 | A | | 11/1977 | Lambel et al. |
| 4,171,208 | A | | 10/1979 | Lowder |
| 4,445,236 | A | | 5/1984 | Nadolny et al. |
| 4,674,137 | A | | 6/1987 | Girse |
| 4,745,641 | A | | 5/1988 | Tash |
| 4,768,237 | A | | 9/1988 | Torti |
| 4,933,017 | A | * | 6/1990 | Brzoska ..... 134/21 |
| 5,105,504 | A | | 4/1992 | Brzoska |
| 5,127,129 | A | | 7/1992 | Frank et al. |
| 5,153,493 | A | * | 10/1992 | Jornod et al. ..... 318/609 |
| 5,193,245 | A | | 3/1993 | Brzoska |
| 5,243,733 | A | | 9/1993 | Steiner et al. |
| 5,664,284 | A | * | 9/1997 | Brzoska ..... 15/330 |

* cited by examiner

*Primary Examiner*—Michael Barr
*Assistant Examiner*—Saeed T. Chaudhry
(74) *Attorney, Agent, or Firm*—Alan G. Towner, Esq.; Pietragallo, Bosick & Gordon LLP

(57) ABSTRACT

A device for alternately applying pressure and vacuum to pipes in order to remove or prevent build-up of undesirable coatings inside the pipes is disclosed. The device includes a pressure and vacuum source connected to a plenum having a hose attached to the plenum at a proximal end and a control mechanism attached to the hose near a distal end. The control mechanism is operable to control the plenum to rapidly switch between variable amounts of vacuum and pressure to the hose. The plenum may also be controlled to supply neither vacuum nor pressure to the hose. The device may be used in a wide variety of settings, including industrial, commercial, marine hospitality industry, and household settings.

22 Claims, 5 Drawing Sheets

METHOD AND APPARATUS FOR UNCLOGGING FLOW SYSTEMS

CROSS-REFERENCE TO RELATED APPLICATION

This application claims the benefit of U.S. Provisional Patent Application Serial No. 60/520,662 filed Nov. 18, 2003, which is incorporated herein by reference.

FIELD OF THE INVENTION

The present invention is directed to an apparatus and method for the safe removal and prevention of build-up of undesirable coatings on inner pipe walls in fluid carrying pipes and systems in industrial, commercial, military, hospitality, food processing, transportation and household applications.

BACKGROUND INFORMATION

Clogs are a common problem in any device in which flowable materials flow through narrow passages. Examples of devices in which clogs occur include drains of plumbing fixtures such as sinks, toilets, bathtubs and showers. Additional examples of devices in which clogs can occur are automobile radiators/cooling systems, heat exchangers and marine engine (outboard, inboard and inboard/outboard) cooling systems, especially those that use seawater for cooling.

One method for cleaning clogs in drains is using a cable drain tool (e.g., a snake). However, tools such as these may damage plumbing fixtures and may prove difficult to use in some situations such as sinks and bathtubs with drains having narrow passages and/or a series of bends. Another method for cleaning drains includes using chemicals including caustics and acids. This method has drawbacks in that the chemicals are highly detrimental to plumbing systems and plumbing fixtures and may cause personal injury and/or destroy metal fittings. Additionally, caustic chemicals may damage PVC pipes and acids may damage porcelain. Yet another method for cleaning clogs involves the use of high pressure devices that may rupture plumbing joints.

In order to address these problems, other methods and devices involving the sequential application of a series of pressure and vacuum pulses have been developed. These methods and devices are described in U.S. Pat. Nos. 5,664,284; 5,193,245; 5,105,504; and 4,933,017, the contents of which are hereby incorporated by reference herein. These methods and devices have proven successful in clearing clogs in a wide variety of applications. However, there is room for improvement in each of these methods and devices.

U.S. Pat. Nos. 5,105,504 and 4,933,017 describe devices that include a mechanism for varying the application of pressure and vacuum forces to a clogged drain that is remote from a hose through which the pressure/vacuum is applied to the drain. Although not apparent from these patents, it has been discovered that in many situations, especially those involving clogged drains in household plumbing fixtures, it is necessary as a practical matter for a first person to hold the hose in place over the clogged drain while a second person manipulates the mechanism to alternate the application of pressure and vacuum. The practical necessity for two people to practice the inventions taught in these patents increases the cost associated with the practice of those inventions.

U.S. Pat. No. 5,193,245, which is a continuation-in-part of the '504 and '017 patents, includes an embodiment depicted in FIGS. 4 and 5 with a trigger 76 located at an end of the hose that controls a solenoid 80 that moves a blade or damper in a control manifold that allows the operator to switch between a vacuum and a pressure position. While this embodiment may allow operation of the device by a single person, it too suffers from a drawback in that the solenoid valve only allows the operator to switch between full pressure and full vacuum. This can be problematic for two reasons. First, when using the device in a fragile environment such as an old plumbing system, it may be desirable to operate the device with only partial pressure and/or partial vacuum for some portion or all of the process. Second, even when full pressure or vacuum are to be used, it is often desirable to slowly build to full pressure or vacuum to avoid shock to fragile systems and/or to avoid agitating waste in, for example, a clogged toilet bowl. The embodiment of FIGS. 4 and 5 do not allow an operator to remotely control the application of partial vacuums or pressures or the application of a slowly building pressure or vacuum.

U.S. Pat. No. 5,664,284 describes a hand held device that includes a trigger 24, shown in FIGS. 1 and 2, that can be manipulated by a person holding the device over a clogged drain to vary the application of pressure and vacuum. However, this hand held device has proven difficult to use in some situations. Also, the hand held device may be considered difficult to lift and position by certain users, which is especially aggravated in a household setting. Furthermore, there are practical constraints on the size, and thus the power, of the motor that creates the vacuum and pressure forces in a hand-held device.

The use of chemicals and agents to remove contaminating materials from the inside surfaces of piping systems is also well known. These chemicals and agents are used in applications from the removal of grease, scale, and bacteria to human hair and other forms of material which block flows. The limitation of these chemicals is their need to reach the surface of the pipe affected by the contamination in a uniform and effective way and stay in contact long enough to be effective. The effect of gravity alone tends to force the chemical or agent to the lower surface of the pipes leaving upper surfaces untouched and untreated.

Some contaminating materials are physically aggressive and adhere or stick to pipe surface resulting in incomplete clearing and cleaning. Mechanical methods e.g., jetters, are sometimes employed to agitate the dispensing of materials but these tend to utilize more active chemicals or agents and reduce the contact time with the contaminated surface.

SUMMARY OF THE INVENTION

The present invention addresses the aforementioned issues to a great extent by providing a device including a pressure and vacuum source connected to a plenum having a hose attached to the plenum at a proximal end and a control mechanism attached to the hose near a distal end, wherein in the control mechanism is operable to control the plenum to rapidly switch between variable amounts of vacuum and pressure to the hose. Preferably, the plenum can also be configured by the control mechanism to supply neither vacuum nor pressure to the hose. The invention is suitable for use in a wide variety of settings, including industrial, commercial, hospitality industry, and household settings.

In some embodiments, the control mechanism can be detached from the end of the hose so that submerging the control mechanism in standing water in order to position the hose end over a clog is not necessary when the standing water is higher than usual. Alternatively, the distance between the control mechanism and the end of the hose can be adjusted to deal with such situations.

In highly preferred embodiments, the control mechanism comprises a potentiometer that is configured to supply an input signal to an actuator control circuit configured to control a motor that moves one or more adjustable vanes in the plenum to provide the desired amount of pressure or vacuum. Alternatively, mechanical control mechanisms are used. In one alternative embodiment, the control mechanism comprises a cable connected at one end to an adjustable vane in a plenum and connected at the other end to an operator controlled lever that allows the operator to manipulate the lever to provide the desired amount of pressure or vacuum.

In yet other embodiments of the invention, a technique referred to herein as pulsed wave cavitation (PWC) involves the use of the above-discussed device or other devices to create a wave motion of the chemical or agent which is reversed at a predetermined interval and whose result is a very complete covering of all surface together with a cavitating effect at the point of wave reversal whose energy level aggressively attacks the contaminants. For applications like sanitizing or disinfecting the same technique of PWC will allow the uniform coating of inside surfaces with materials that will have a lasting effect on the surfaces.

An aspect of the present invention is to provide an apparatus for variably applying pressure and vacuum to fluid contained in a pipe to remove, reduce and/or prevent build-up of unwanted coatings in the pipe comprising: a source of pressure and vacuum, a hose having a proximal end connected to the source of pressure and vacuum and a distal end adapted and configured to provide a seal between the hose and the pipe, and control means near the distal end of the hose for variably controlling the amounts of pressure and/or vacuum applied through the hose to the pipe.

Another aspect of the present invention is to provide a method of removing, reducing and/or preventing build-up of unwanted coatings in a pipe. The method comprises providing a source of pressure and vacuum, providing a hose having a proximal end connected to the source of pressure and vacuum and a distal end adapted and configured to provide a seal between the hose and the pipe, and variably controlling amounts of pressure and/or vacuum applied through the hose to the pipe with a controller mounted near the distal end of the hose.

These and other aspects of the present invention will be more apparent from the following description.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION

The present invention will be discussed with reference to preferred embodiments of clog removing devices. Specific details are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1:
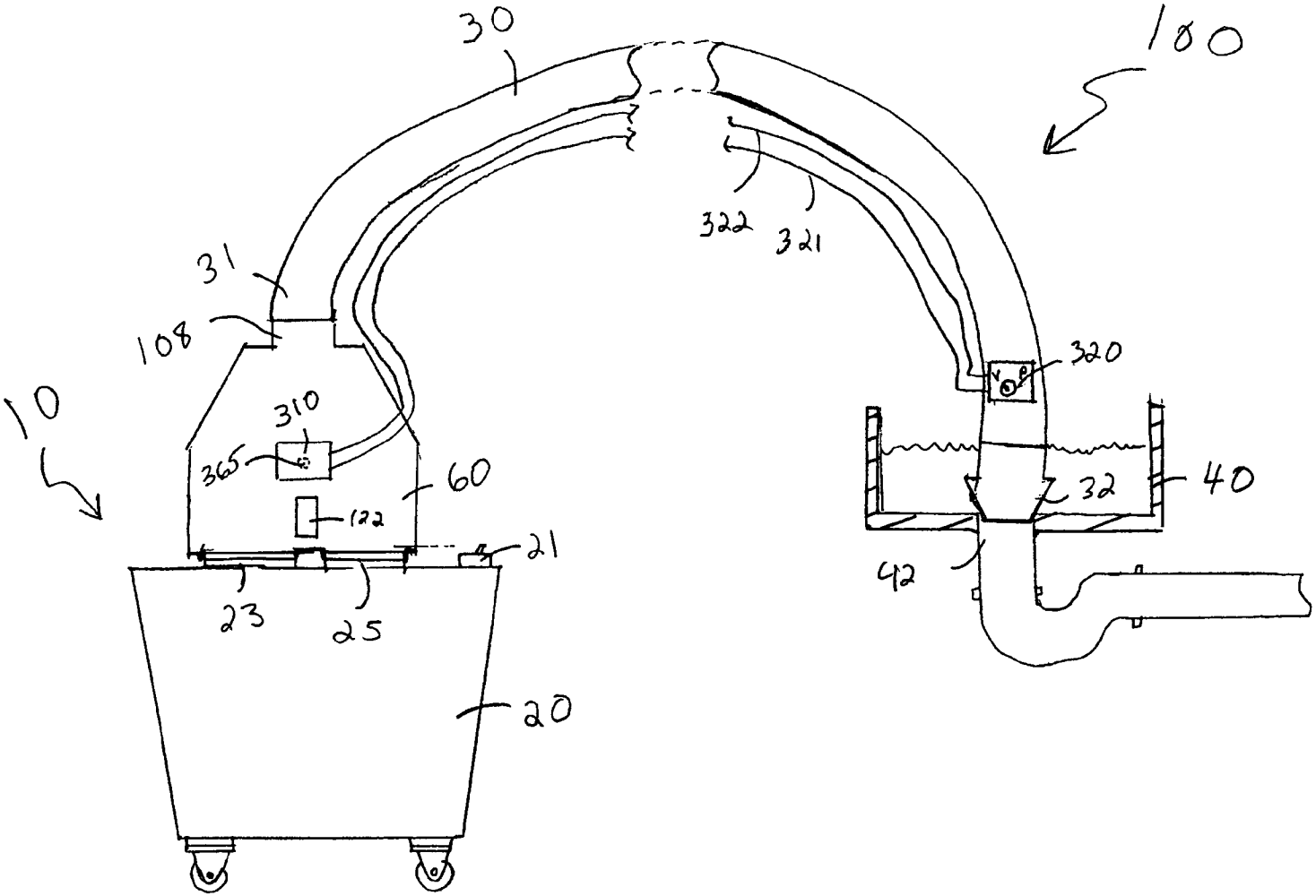
FIG. 1 is a perspective view of an unclogging device according to one embodiment of the invention.
Figure 2:
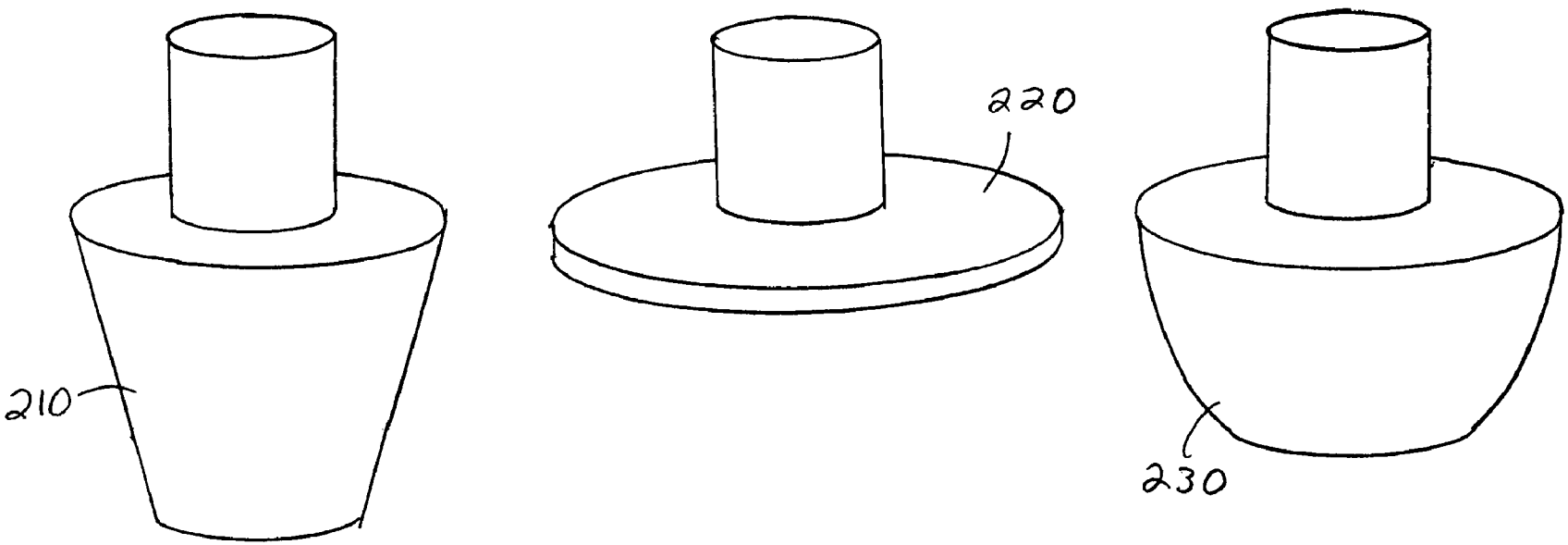
FIGS. 2*a*–2*c* are perspective views of attachable accessories suitable for use with the unclogging device of FIG. 1.

FIG. 1 is a perspective view of an unclogging device 10 according to a preferred embodiment of the present invention. The unclogging device 10 includes a collection chamber 20 in which is mounted a blower motor (not shown in FIG. 1) for creating a vacuum at port 23 and pressure at port 25. Although a single blower motor is used to create both the pressure and vacuum in preferred embodiments, it is also possible to practice the invention with separate vacuum and pressure sources. The collection chamber 20 collects materials drawn into vacuum port. The blower motor is controlled by on/off switch 21. Connected to the ports 23 and 25 is a plenum 60. The plenum 60 includes a vane (not shown in FIG. 1) mounted on a shaft 365 (shown in phantom in FIG. 1) which is rotated by actuator 310. A hose 30 is attached at one end 31 to an inlet/outlet sleeve 108 at the plenum 60. The other end 32 of the hose 30 is inserted into a pipe or drain 42 of a clogged sink 40. The hose end 32 is preferably shaped, either integrally or through use of attachable accessories, so that a tight fit between the hose end 32 and drains 42 of different diameters and configurations can be made to provide a seal between the hose end 32 and the drain 42. Preferred embodiments of attachable accessories 210, 220, 230 suitable for use with the invention are illustrated in FIGS. 2*a*, 2*b* and 2*c*, respectively. Accessory 210 gives the hose end 32 a flared configuration as illustrated in FIG. 1. Providing a variety of attachable accessories makes the device 10 suitable for use with a wide variety of flow systems. Those of skill in the art will recognize that a wide variety of shapes and configurations for such attachable accessories are possible and are within the purview of the present invention.

In one embodiment of the invention, additives such as solvents, degreasers, soaps, abrasives, colloidal chemicals, corrosion inhibitors, bactericides and viricides may be supplied to the pipe or drain 42 using any suitable means. For example, a port and fitting 36 may be provided at any suitable location on the hose 30, or at any other location which provides flow communication with the pipe or drain 42.

Referring now back to FIG. 1, near the flared end 32 of the hose 30 is mounted a potentiometer 320. Two wires 321, 322 connect the potentiometer to the actuator 310. As will be discussed in further detail below, the actuator 310 allows the operator to control the amount of pressure/vacuum that is applied to the drain 42. The potentiometer 320 of FIG. 1 is of a type that is manipulated by turning a round knob, but any type of potentiometer may be used. The potentiometer 320 is preferably mounted on the hose 30 in a manner that will allow a user to reposition the potentiometer 320 on the hose 30 if necessary to avoid submerging the potentiometer 320 in standing water around a drain into which the flared hose end 32 is inserted. In some embodiments, the potentiometer 320 is mounted to the hose 30 by a spring clip that extends partially around the circumference of the hose. This allows the potentiometer 320 to be slid along the hose to different distances from the flared end 32 or to be removed from the hose end 30. (In other embodiments, a simple on/off switch may be used in place of the potentiometer 320).

Figure 3:
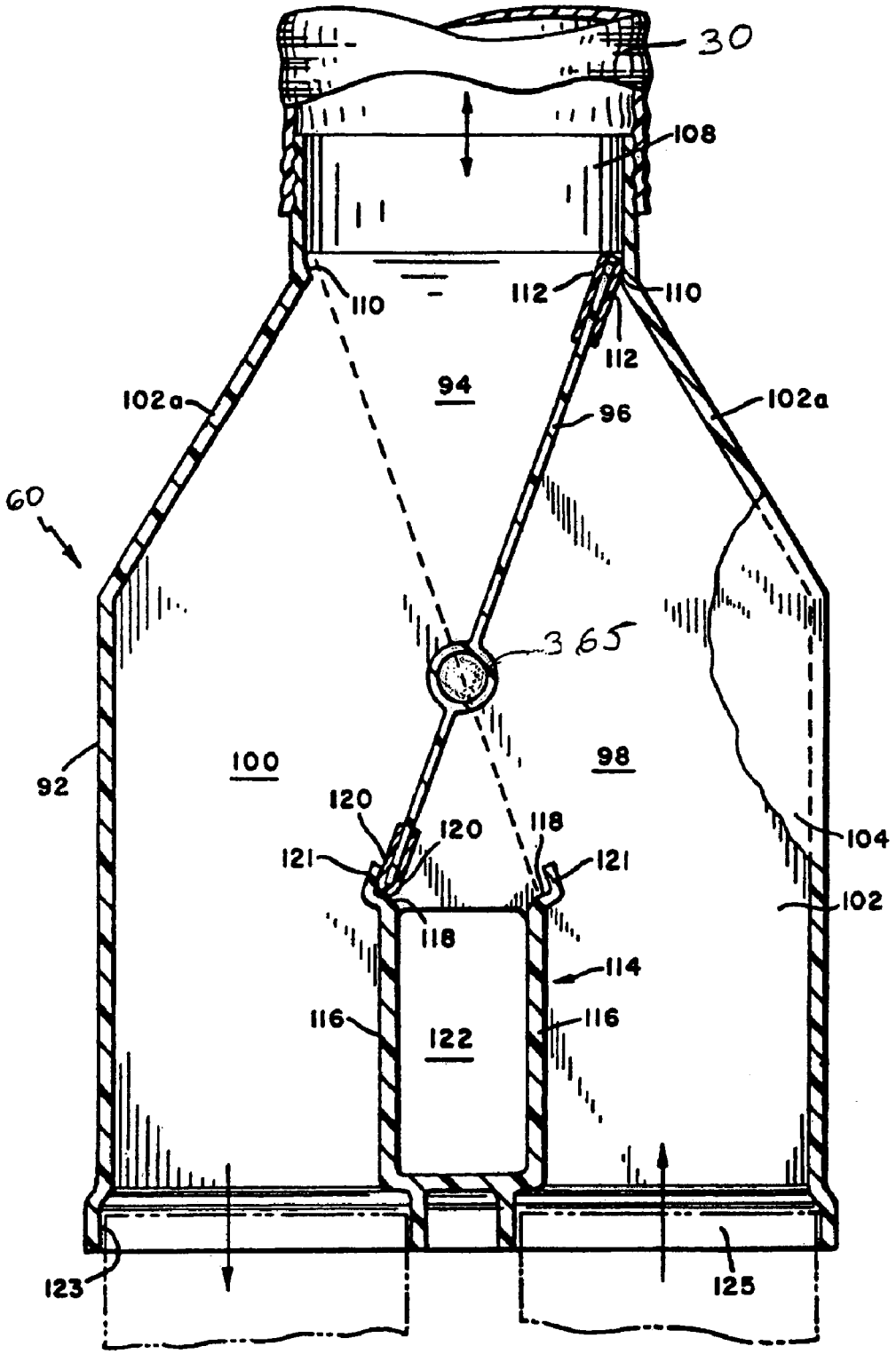
FIG. 3 is a cross sectional view of a plenum of the unclogging device of FIG. 1.

FIG. 3 is a cross sectional view of the plenum 60 of FIG. 1. The plenum 60 includes a housing 92 that forms an interior chamber 94 in which is mounted a movable vane, or damper, 96 mounted on a shaft 365 for directing pressure and vacuum pulses to the drain 42. The interior chamber 94 includes a pressure chamber 98 through which pressurized air from port 125 (supplied by the motor in the collection chamber 20 of FIG. 1 via port 25) is applied to the hose 30 via inlet/outlet sleeve 108 and/or vented to the atmosphere via exhaust port 122, depending on the position of the vane 96. The interior chamber 94 also includes a vacuum port 100 through which the vacuum from port 123 (supplied by the motor in the collection chamber 20 of FIG. 1 via port 23) is applied to the hose 30 and/or vented to the atmosphere via exhaust port 122, again depending upon the position of the vane 96. The inner surfaces 110 of the side walls 102*a* are tapered just below the inlet/outlet sleeve 108 to form a sealing surface for engaging the upper sealing surfaces 112 on both sides of the vane 96.

The plenum 60 also includes an interior partition 114 comprising vertically oriented, spaced apart partition walls 116 that extend between and are attached to the front wall 104 and rear wall 102 of the plenum 60. The interior partition 114 is preferably molded integrally with the plenum 60. The upper edges 118 of each partition wall 116 are beveled to provide a sealing surface for engaging the lower sealing surfaces 120 of the vane 96. Additionally, a stop shoulder 121 is located at the upper edge of each partition wall 116 for limiting movement of the vane 96.

The provision of the sealing surfaces 112, 120 on the vane 96, 121 on the partition 114, and 110 on the tapered side walls 102*a* ensure that full vacuum or pressure is supplied to the hose 108 when the vane 96 is in a corresponding full vacuum or pressure position.

Figure 4:
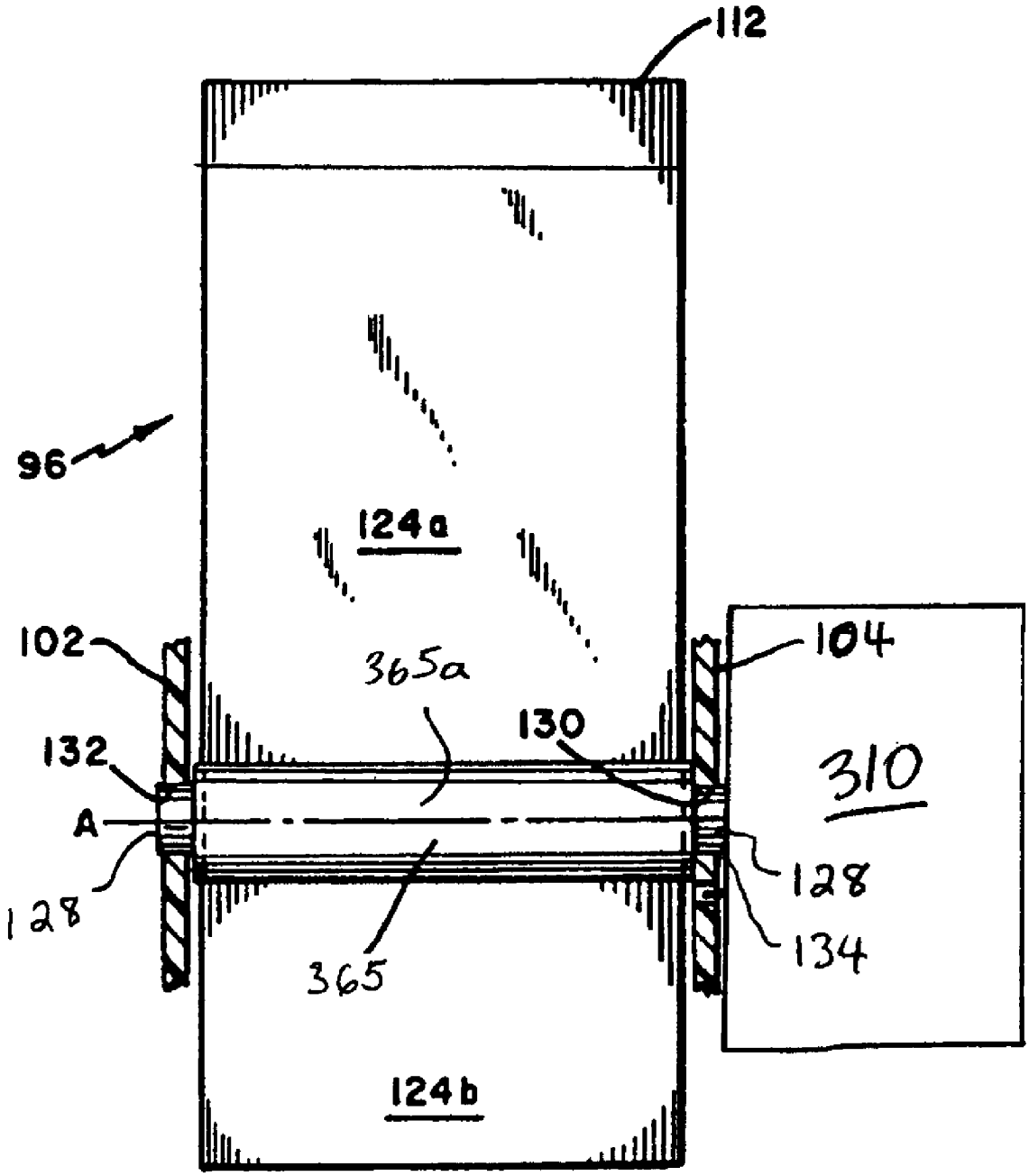
FIG. 4 is a side view of a vane in the plenum of FIG. 3.

FIG. 4 is a side view of the vane 96 of FIG. 3. The vane 96 is generally rectangular and is divided into major 124*a* and minor 124*b* parts along a pivot axis A—A defined by a pivot hub 365 which is hollow in the enlarged portion 365*a*. The ends 128 of the hub 365 extend through the walls 102, 104 at openings 132, 134.

Figure 5:
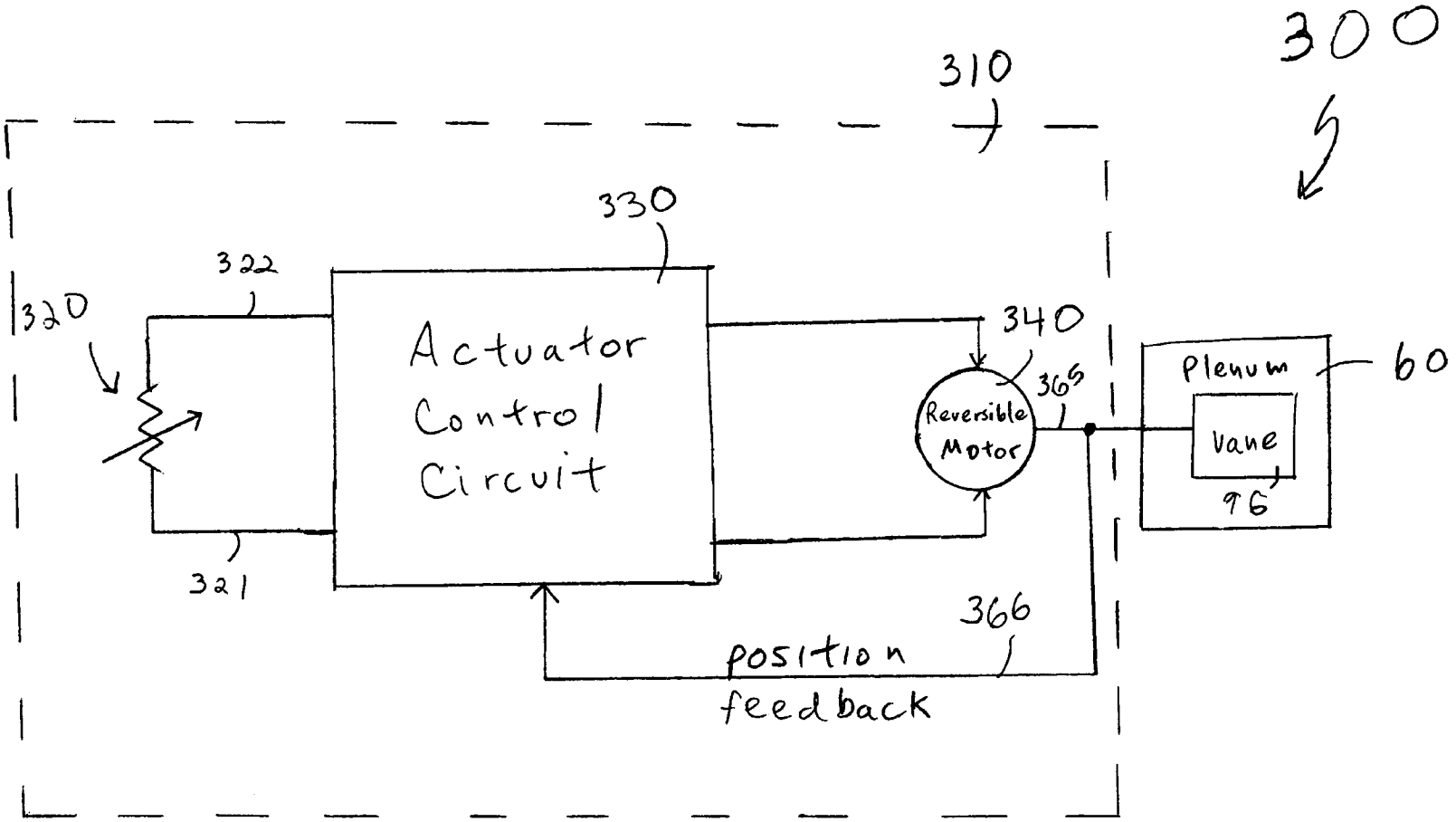
FIG. 5 is a block diagram of a control system for controlling a vane in the plenum of FIG. 3.

FIG. 5 is a block diagram 300 of the actuator 310 that controls movement of the vane 96 in the plenum 60 of FIG. 3. Moving the vane 96 controls the amount of vacuum or pressure supplied to the hose 30. The shaft 365 to which the vane 96 is attached is connected to a reversible electric motor 340, which operates under the control of an actuator control circuit 30. The actuator control circuit 30 controls the motor 340 to position the shaft 365 in accordance with a variable element in the form of a potentiometer 320. The actuator control circuit receives a position feedback input 366 indicative of the position of the shaft 365. In FIG. 3, the feedback input 366 comprises a mechanical connection between the shaft 365 and a wiper of a second potentiometer forming part of the actuator control circuit 330.

Actuator control circuits are well known in the HVAC and valve control fields. Exemplary actuator control circuits are illustrated in U.S. Pat. Nos. 5,153,493 and 3,975,669, the contents of which are hereby incorporated by reference herein. The details of actuator control circuit 330 will not be discussed in further detail herein. It will be recognized by those of skill in the art that actuator control circuits employing types of variable circuit elements other than potentiometers and types of feedback arrangements (e.g., a feedback signal derived from a synchro connected to the shaft 365) could be used in place of the feedback input 366.

An important aspect of actuator control circuit 330 is that it allows an operator to control, via the potentiometer 320, the vane 96 to provide full vacuum, full pressure, or varying degrees of each. This allows a user to limit the highest amount of pressure or vacuum being applied, which can be very important when dealing with fragile plumbing systems. This feature also allows a user to position the vane 96 in a "neutral" position in which no net vacuum or pressure is being supplied to the hose, thereby avoiding disturbing any standing water or other debris in a sink/toilet/tub before the hose is in the desired position. This should be contrasted with devices which default to a vacuum setting, which can cause undesired vacuuming and/or agitation of standing water and debris surrounding the drain.

Once the hose is in its desired position over a drain, the actuator control circuit 330 allows the operator to control the rate at which the pressure or vacuum increases and decreases so that an amount of vacuum/pressure appropriate for the job is applied via the potentiometer 320. Moreover, because the potentiometer 320 is located near an end of the hose 320, the aforementioned control of the vane 96 can be accomplished while the same user holds the hose in position over the drain 42, thereby eliminating the need for a second person while not burdening a single user with the necessity of positioning an entire device over a drain as is the case with the device of U.S. Pat. No. 5,664,284. Among other things, this allows the use of a larger, more powerful blower motor than would otherwise be possible or desirable.

The invention may be practiced with actuator control circuits that allow continuous variation in the positioning of the vane 96 between the vacuum and pressure positions. However, it is also possible to practice the invention with actuator control circuits that allow the vane 96 to be positioned in one of a number of discrete positions between the full vacuum and full pressure positions.

In addition to the actuator control mechanisms of the preferred embodiments discussed above, other types of control mechanisms may also be used. One example of such a control mechanism is similar to the type used for throttle control in power equipment such as lawnmowers and on bicycles for brake and derailleur control. Such a control mechanism comprises a sheathed cable connected at one end to an adjustable vane in a plenum (e.g., the vane 96 of plenum 60) and connected at the other end (which may be located at the end of hose 30 in a position similar to potentiometer 320) to an operator controlled lever that allows the operator to manipulate the lever to provide the desired amount of pressure or vacuum. Such embodiments may include a biasing spring attached between the vane and the plenum such that the biasing spring urges the vane toward the vacuum position or, in some embodiments, the neutral position. The operator controlled lever may move freely (such as a brake cable on a bicycle) such that the operator is required to maintain pressure on the lever to keep the lever in any position other than full vacuum as urged by the biasing spring. Alternatively, the operator controlled lever may be provided with friction (such as a gear shift cable that controls the derailleur on a bicycle) such that the lever remains in the position selected by the operator even if the operator releases the lever. Other types of control mechanisms are also possible.

Although the use of a vane valve as illustrated in FIGS. 3 and 4 is primarily described herein, any other suitable type of valve may be used in accordance with the present invention. For example, rotary valves may be used, such as described in U.S. Provisional Application Serial No. 60/629,124 filed Nov. 18, 2004 entitled "Rotary Fluid Flow Valve", which is incorporated herein by reference. Such a rotary valve may be tubular in configuration with an inner cylinder that rotates with respect to an outer cylinder. Vacuum and pressure lines are connected through openings in the outer wall of the outer cylinder, and holes selectively positioned through the walls of the inner cylinder pass by the vacuum and pressure openings of the outer cylinder as the inner cylinder rotates to alternatively apply vacuum and pressure. The inner cylinder may be manually rotated or may be motor driven at any desired rotational speed.

In another embodiment of the invention, pulsed wave cavitation (PWC) involves the use of the above-discussed devices or other devices to create a wave motion of the chemical or agent which is reversed at a predetermined interval. The result is a very complete covering of all surface together with a cavitating effect at the point of wave reversal whose energy level aggressively attacks the contaminants. For applications like sanitizing or disinfecting the same technique of PWC allows the uniform coating of inside surfaces with materials who will have a lasting effect on the surfaces. The high energy in this wave or pulse can also be combined with a specially blended colloid added to the chemical or agent whose action will be to act as an abrasive together with the base chemical or agent to cause a scouring effect. The pulsed wave cavitation effect may be coupled with commercially available cleansing/decontamination fluids such as solvents, degreasers, soaps, suspended abrasives, colloidal chemicals, corrosion inhibitors, bactericides, viricides and the like, which accelerate the cleaning capabilities of the apparatus in the removal of unwanted films from the pipe wall interiors. Such fluids may be selected such that they perform optimally when coupled with the pulsed wave cavitation effect generated by the apparatus, as opposed to being used as a cleansing fluid under non-PWC agitation. After being applied using the PWC process, such fluids may provide a thin film residue on the pipe walls in order to provide corrosion inhibition, reduce surface tension (to eliminate the build-up of films), reduce and/or eliminate post treatment bio-fouling and/or seal the pipe wall from the flowing stream to prevent pipe materials from leaching chemicals into the stream. For example, the occurrence of lead leaching from drinking water pipes may be reduced or eliminated.

Preferably, protocols of pressure/vacuum amounts and timing can be developed to automatically control the device to perform a complete a cycle of cleaning and stripping with a follow on sanitizing step to effect a complete piping system refurbishment. The wave action can be created in several ways and the key action is at the point where the wave reverses direction causing the cavitating effect. As discussed previously, a colloid can be added to an existing chemical formula to enhance it's effectiveness when combined in an agitated medium. Pulse wave cavitation is one such medium but others where similar agitation and covering are present will also function. The ability to ensure complete coating of inside services could allow proactive sanitizing programs to be uniquely effective for killing e.g. viruses and bacteria.

Whereas particular embodiments of this invention have been described above for purposes of illustration, it will be evident to those skilled in the art that numerous variations of the details of the present invention may be made without departing from the invention as defined in the appended claims.

The invention claimed is:

1. An apparatus for variably applying pressure and vacuum to fluid contained in a pipe to remove, reduce and/or prevent build-up of unwanted coatings in the pipe comprising:

a source of pressure and vacuum;

a hose having a proximal end connected to the source of pressure and vacuum and a distal end adapted and configured to provide a seal between the hose and the pipe;

a valve in fluid communication between the source of pressure and vacuum; and control means near the distal end of the hose for variably controlling amounts of pressure and/or vacuum applied through the hose to the pipe by moving the valve to selected positions corresponding to varying degrees of pressure and varying degrees of vacuum.

2. The apparatus of claim 1, wherein the control means includes incrementally selectable pressure levels.

3. The apparatus of claim 1, wherein the control means includes continuously selectable pressure levels.

4. The apparatus of claim 1, wherein the control means includes incrementally selectable vacuum levels.

5. The apparatus of claim 1, wherein the control means includes continuously selectable vacuum levels.

6. The apparatus of claim 1, wherein the control means includes incrementally selectable pressure and vacuum levels.

7. The apparatus of claim 1, wherein the control means includes continuously selectable pressure and vacuum levels.

8. The apparatus of claim 1, wherein the control means comprises a potentiometer mounted near the distal end of the hose.

9. The apparatus of claim 8, wherein the potentiometer is controlled by a rotatable knob.

10. The apparatus of claim 1, wherein the apparatus includes means for generating reversible wave motion of the fluid contained in the pipe.

11. The apparatus of claim 1, further comprising means for supplying an additive to the fluid.

12. The apparatus of claim 11, wherein the additive is selected from solvents, degreasers, soaps, abrasives, colloidal chemicals, corrosion inhibitors, bactericides and viricides.

13. The apparatus of claim 11, wherein at least a portion of the additive remains on an inner wall of the pipe after the pressure and/or vacuum is applied to the pipe.

14. The apparatus of claim 1, wherein the source of pressure and vacuum is contained in a single housing.

15. The apparatus of claim 1, wherein the apparatus comprises a collection chamber having a blower motor mounted therein for creating the pressure and/or vacuum.

16. The apparatus of claim 15, wherein the blower motor creates both the pressure and the vacuum.

17. The apparatus of claim 1, wherein the apparatus comprises separate vacuum and pressure sources.

18. A method of removing, reducing and/or preventing build-up of unwanted coatings in a pipe, the method comprising:

providing a source of pressure and vacuum;

providing a hose having a proximal end connected to the source of pressure and vacuum and a distal end adapted and configured to provide a seal between the hose and the pipe;

providing a valve in fluid communication between the source of pressure and vacuum and the hose; and controlling variable amounts of pressure and/or vacuum applied through the hose to the pipe with a controller mounted near the distal end of the hose by moving the valve to selected positions corresponding to varying degrees of pressure and varying degrees of vacuum.

19. The method of claim 18, further comprising generating reversible wave motion of the fluid contained in the pipe.

20. The method of claim 18, further comprising supplying an additive to the fluid.

21. The method of claim 20, wherein the additive is selected from solvents, degreasers, soaps, abrasives, colloidal chemicals, corrosion inhibitors, bactericides and viricides.

22. The method of claim 20, wherein at least a portion of the additive remains on an inner wall of the pipe after the pressure and/or vacuum is applied to the pipe.

* * * * *